US010836176B2

(12) United States Patent
Haines et al.

(10) Patent No.: US 10,836,176 B2
(45) Date of Patent: Nov. 17, 2020

(54) FLUID CARTRIDGE

(71) Applicant: Hewlett-Packard Development Company, L.P., Spring, TX (US)

(72) Inventors: Paul Mark Haines, Corvallis, OR (US); Aik Liang Roy Teh, Singapore (SG); Suriyaprakash Saravanan, Singapore (SG); Anjan Prabhat Pattathil, Singapore (SG)

( * ) Notice: Subject to any disclaimer, the term of this patent is extended or adjusted under 35 U.S.C. 154(b) by 0 days.

(21) Appl. No.: 16/483,289

(22) PCT Filed: Feb. 10, 2017

(86) PCT No.: PCT/US2017/017489

§ 371 (c)(1),
(2) Date: Aug. 2, 2019

(87) PCT Pub. No.: WO2018/147870

PCT Pub. Date: Aug. 16, 2018

(65) Prior Publication Data

US 2020/0009874 A1 Jan. 9, 2020

(51) Int. Cl.
*B41J 2/175* (2006.01)

(52) U.S. Cl.
CPC ..... *B41J 2/17553* (2013.01); *B41J 2/17513* (2013.01); *B41J 2/17596* (2013.01)

(58) Field of Classification Search
CPC . B41J 2/17553; B41J 2/17513; B41J 2/17596
See application file for complete search history.

(56) References Cited

U.S. PATENT DOCUMENTS 6,033,064 A 3/2000 Pawlowski, Jr.
6,789,874 B1 9/2004 Dietl
(Continued)

FOREIGN PATENT DOCUMENTS

CN 101132918 B 12/2010
CN 102079167 A 6/2011
(Continued)

OTHER PUBLICATIONS

IP.com search (Year: 2020).*
Burkert Contromatic Limited—Digital Inkjet Printing, < https://www.burkert.co.uk/—5 pages—Nov. 2016.

*Primary Examiner* — Lisa Solomon
(74) *Attorney, Agent, or Firm* — Lakshmikumaran and Sridharan

(57) ABSTRACT

The subject matter discloses a fluid cartridge comprising a container to hold a predetermined volume of fluid, and a lid for closing the container. The lid comprises a valve-recess and an inlet valve in the valve-recess to transfer a volume of a replacement fluid in the container for replacing depleted volume of fluid in the container. A rocker valve is pivoted in the valve-recess to cover the inlet valve during a regulation phase. The rocker valve is to open the inlet valve during an actuation phase to allow the replacement fluid to enter the container. A spring element is movably disposed on the rocker valve to control actuation of the rocker valve for opening and closing the inlet valve. The spring element slides across the rocker valve, from a regulation zone of the rocker valve to an actuation zone of the rocker valve, to open the inlet valve.

15 Claims, 9 Drawing Sheets

(56) References Cited

U.S. PATENT DOCUMENTS

| | | | |
|---|---|---|---|
| 7,618,135 | B2 | 11/2009 | Stathem et al. |
| 9,056,479 | B2 | 6/2015 | Stathem et al. |
| 9,352,575 | B2 | 5/2016 | Suzuki |
| 9,452,614 | B2 | 9/2016 | Olsen et al. |
| 2003/0142184 | A1 | 7/2003 | Haines et al. |
| 2005/0219337 | A1 | 10/2005 | Martinez-Pacheco |
| 2007/0280722 | A1 | 12/2007 | Katada et al. |
| 2009/0091606 | A1* | 4/2009 | Haines ..... B41J 2/17556 347/85 |

FOREIGN PATENT DOCUMENTS

| | | | |
|---|---|---|---|
| CN | 102171045 | B | 11/2013 |
| EP | 0778146 | B1 | 1/2000 |
| EP | 2322350 | | 5/2011 |
| JP | 2008162217 | | 7/2008 |
| PT | 2195172 | | 6/2012 |

* cited by examiner

FLUID CARTRIDGE

BACKGROUND

Fluid cartridges are used as a source of fluid, such as ink, liquid toner, and other printing fluids for printing devices and lab equipment. For instance, fluid cartridges are used as a source of ink for a printhead of a printer.

BRIEF DESCRIPTION OF DRAWINGS

The detailed description is described with reference to the accompanying figures. It should be noted that the description and figures are merely example of the present subject matter and are not meant to represent the subject matter itself.

Figure 1:
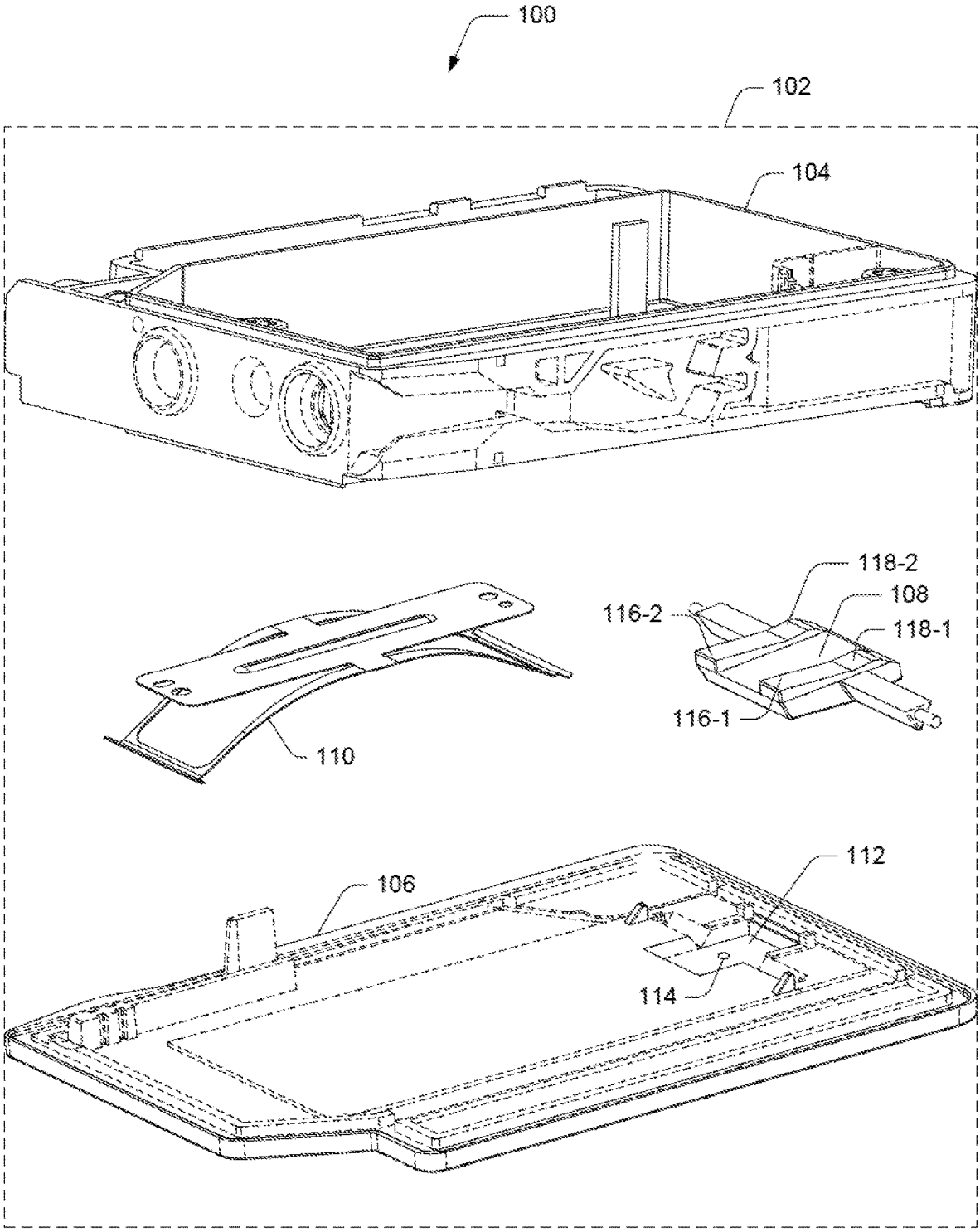
FIG. 1 illustrates an exploded view of a fluid cartridge, according to an example implementation of the present subject matter.

Throughout the drawings, identical reference numbers designate similar, but not necessarily identical, elements. The figures are not necessarily to scale, and the size of some parts may be exaggerated to more dearly illustrate the example shown. Moreover, the drawings provide examples and/or implementations consistent with the description; however, the description is not limited to the examples and/or implementations provided in the drawings.

DETAILED DESCRIPTION

Fluid cartridges include a container for holding fluid and a lid for covering an open side of the container. The fluid cartridges further include a pressure unit to maintain a negative pressure inside the fluid cartridge for regulating and controlling flow of the fluid to a printhead. The pressure unit generally includes an arrangement of a bag, a spring element, a lever, a valve ball, and a valve seat disc. As the fluid within the container depletes due to consumption, pressure inside the container increases, owing to which the bag inflates to control the pressure. As the bag inflates, the spring pressed against the bag moves the lever, and in turn, the valve ball and the valve seat disc. The valve seat disc thus retracts and opens an inlet valve provided on the container body. Opening the inlet valve allows a replacement fluid to enter in the container, for replacing the depleted volume of fluid.

As the replacement fluid fills the container, the bag deflates, moving the spring, the lever, the valve ball, and the valve seat disc to a default position. The replacement fluid, in one example, may be air. In another example, the replacement fluid may be fluid, received from an external fluid source connected to the fluid cartridge. Further, to allow the fluid to flow to the inlet valve provided in the container, a fluid channel directly connected to the inlet valve may be provided on an outer surface of the container.

As the valve seat disc and the valve ball are manufactured using rubber, the disc may at times become slightly sticky due to mild property changes, for example, in high temperatures. The valve seat disc may, thus, stick to the inlet valve and not open to allow the replacement fluid to enter the container. Failure to allow the replacement fluid to enter the container may cause undue increase in the pressure, possibly leading to a print failure.

Example implementations for a fluid cartridge are described. As per an example of the present subject matter, the fluid cartridge includes a rocker valve for regulating operation of an inlet valve. In said approach, the fluid cartridge includes a container to hold the fluid and a lid for closing the container, the lid having an inlet valve provided in a valve-recess to transfer a replacement fluid for replacing a depleted volume of fluid in the container. The rocker valve is to cover the inlet valve during a regulation phase and open the inlet valve during an actuation phase to allow the replacement fluid to enter the container.

The fluid cartridge includes a bag, a spring element, and the rocker valve pivoted in the valve-recess. In one example, the spring element is movably disposed on the rocker valve to control actuation of the rocker valve for opening and closing the inlet valve in accordance to inflation and deflation of the bag. For instance, when the bag is deflated, the spring element is disposed in a regulation zone of the rocker valve to operate the rocker valve in the regulation phase. When the bag is inflated, the spring element slides across the rocker valve to be disposed in an actuation zone of the rocker valve to actuate the rocker valve to operate in the actuation phase.

Further, in case a hyperinflation phase occurs, the spring element slides off the rocker valve to be disposed in a hyperinflation zone proximal to a second end of the valve-recess to allow the bag to be hyper-inflated for priming the fluid cartridge. As the spring element slides off the rocker valve, the rocker valve pivots back to the regulation phase, closing the inlet valve, thus allowing the bag to efficiently hyperinflate for priming. In one example, the rocker valve comprises a downward slant, proximal to the second end of the valve-recess, to allow the movement of the spring element between the actuation zone of the rocker valve and the hyperinflation zone of the valve-recess.

In one example implementation of the present subject matter, a first fluid channel is provided on an outer surface of a first wall of the container to receive the replacement fluid from an external source. The container further includes an intermediate fluid channel fluidly coupled to the first fluid channel and a second fluid channel of the lid, for transferring the replacement fluid to the lid. The second fluid channel is further connected to the inlet valve to allow the replacement fluid to enter the lid.

The present subject matter thus facilitates an uninterrupted functioning of the fluid cartridge and consequently the device, such as a printhead, into which the fluid cartridge may be implemented. Combined movement of the spring element and the rocker valve provides a controlled and regulated opening of the inlet valve. As the rocker valve operates in accordance to the sliding movement of the spring element and the pivotal movement of the rocker valve over the wedge shaped fulcrum, possible malfunctioning of the rocker valve at the time of opening the inlet valve is avoided. Further, in one example, the valve seat disc is press-fitted inside a first recess of the rocker valve, thus eliminating the chances of the valve seat disc being stuck to the inlet valve.

Further, providing the intermediate fluid channel and the second fluid channel to transfer of the replacement fluid from the container to the lid allows the present print cartridge to be used in existing printers without modification. As the replacement fluid is initially received by the first fluid channel provided on the outer surface of the container, existing ports used for receiving the replacement fluid from the external sources may be used without any modification.

The present subject matter is further described with reference to FIGS. 1 to 10. It should be noted that the description and figures merely illustrate principles of the present subject matter. Various arrangements may be devised that, although not explicitly described or shown herein, encompass the principles of the present subject matter. Moreover, all statements herein reciting principles, aspects, and examples of the present subject matter, as well as specific examples thereof, are intended to encompass equivalents thereof.

FIG. 1 illustrates an exploded view 100 of a fluid cartridge 102, according to an example implementation of the present subject matter. In one implementation, the fluid cartridge 102 may hold a fluid, such as ink, liquid toner, and other printing fluids for printing devices and lab equipment. The fluid cartridge 102 may include a container 104, a lid 106 of the container 104, a rocker valve 108, and a spring element 110. The container 104 is provided to hold a predetermined volume of the fluid and the lid 106 is provided for closing the container 104. The exploded view 100 illustrates a top view of the container 104 and a bottom view of the lid 106 to illustrate inner surfaces of the container 104 and the lid 106. As seen in FIG. 1, various components for which no protection is sought have been illustrated using dotted lines.

The lid 106 includes a valve-recess 112 and an inlet valve 114 in the valve-recess 112. The inlet valve 114 is provided to allow transfer of a replacement fluid in the container 104 for replacing a depleted volume of fluid in the container 104. Further, the rocker valve 108 is pivoted in the valve-recess 112 to cover the inlet valve 114 during a regulation phase to prevent the replacement fluid from entering the container 104. The rocker valve 108 further is to open the inlet valve 114 during an actuation phase to allow the replacement fluid to enter the container 104.

In one implementation, the spring element 110 is movably disposed on the rocker valve 108 to control actuation of the rocker valve 108. The spring element 110 may control actuation of the rocker valve 108 for opening and closing the inlet valve 114. For instance, the spring element 110 may slide across the rocker valve 108, from regulation zones 116-1 and 116-2 of the rocker valve 108 to actuation zones 118-1 and 118-2 of the rocker valve 108 to open the inlet valve 114. The regulation zones 116-1 and 116-2, hereinafter, are collectively referred to as regulation zone 116 and individually as regulation zone 116. The actuation zones 118-1 and 118-2, hereinafter, are collectively referred to as actuation zone 118 and individually as actuation zone 118.

Figure 2:
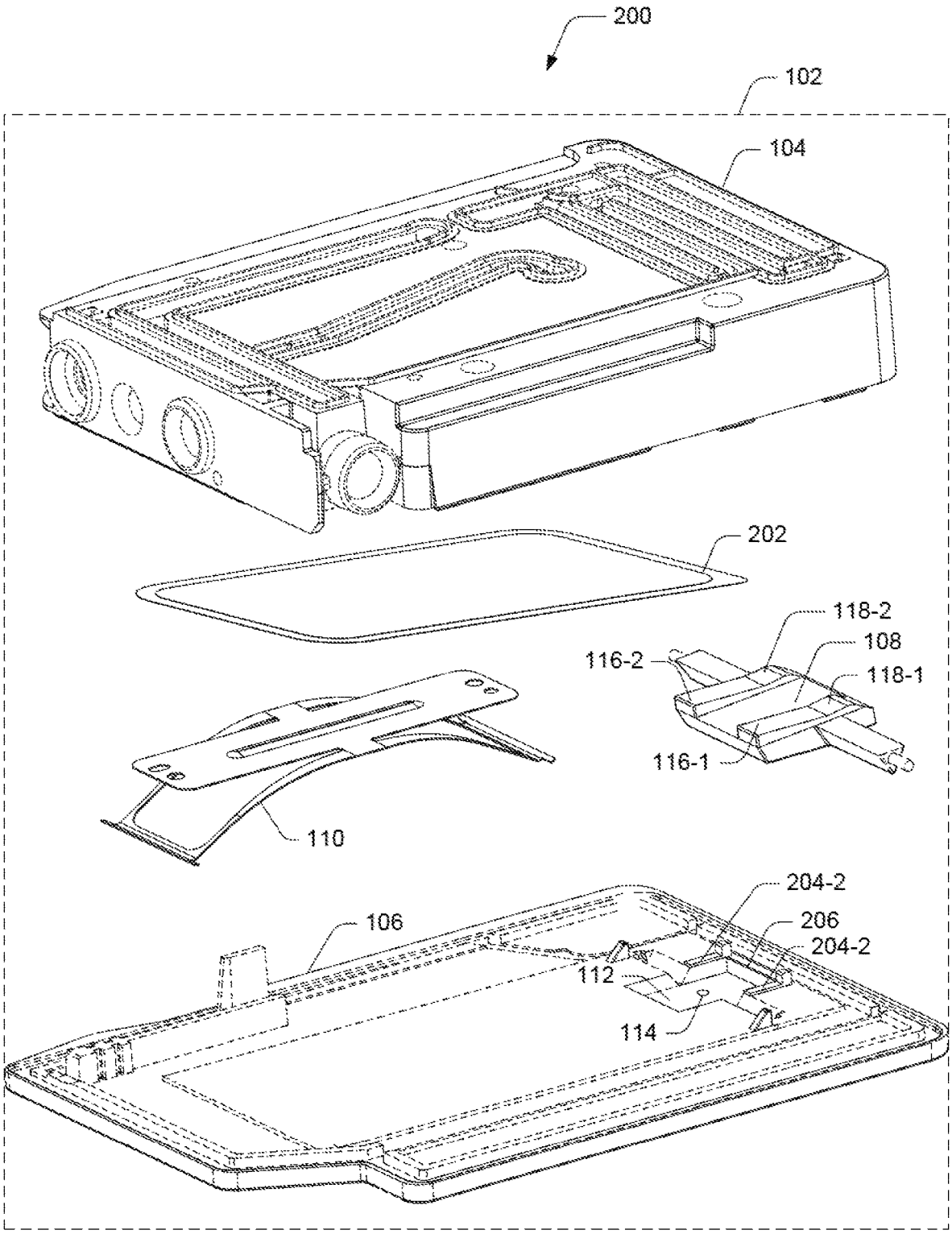
FIG. 2 illustrates an exploded view of a fluid cartridge, according to another example implementation of the present subject matter.

FIG. 2 illustrates an exploded view 200 of the fluid cartridge 102, according to another example implementation of the present subject matter. In one example, the fluid cartridge 102 includes the container 104 to hold a predetermined volume of the fluid and the lid 106 for closing the container 104. In one example, the lid 106 includes the valve-recess 112 and the inlet valve 114 placed in the valve-recess 112. As previously described, the inlet valve 114 is provided to transfer the replacement fluid for replacing the depleted volume of the fluid in the container 104. The exploded view 200 illustrates a bottom view of the container 104 and the lid 106 to illustrate an outer surface of the container 104 and an inner surface the lid 106. As seen in FIG. 2, various components for which no protection is sought have been illustrated using dotted lines.

The fluid cartridge 102 further includes the rocker valve 108 pivoted in the valve-recess 112. The rocker valve 108 covers the inlet valve 114 during the regulation phase and opens the inlet valve 114 during the actuation phase to allow the replacement fluid to enter the container 104. The fluid cartridge 102 also includes a bag 202 disposed on the container 104 to maintain pressure inside the container. In one implementation, the bag 202 inflates as the pressure inside the container 104 increases due to depletion of the fluid from the container 104.

In one implementation, the fluid cartridge 102 includes the spring element 110 mounted on the lid 106 and pressed against the bag 202 to restrain the bag from inflating. In one example, the spring element 110 is movably disposed on the rocker valve 108 to control actuation of the rocker valve 108 for opening and closing the inlet valve 114. Further, in a hyperinflation phase, the spring element 110 slides off the rocker valve 108 to be disposed in a hyperinflation zone 204-1 and 204-2. In one example, hyperinflation zone 204-1 and 204-2 is provided proximal to a second end 206 of the valve-recess 112. Further, the spring element 110 slides off to be disposed in the hyperinflation zone 204-1 and 204-2 to allow the bag 202 to be hyper-inflated for priming the fluid cartridge 102. The hyperinflation zone 204-1 and 204-2, hereinafter, are collectively referred to as hyperinflation zone 204 and individually as hyperinflation zone 204.

Figure 3:
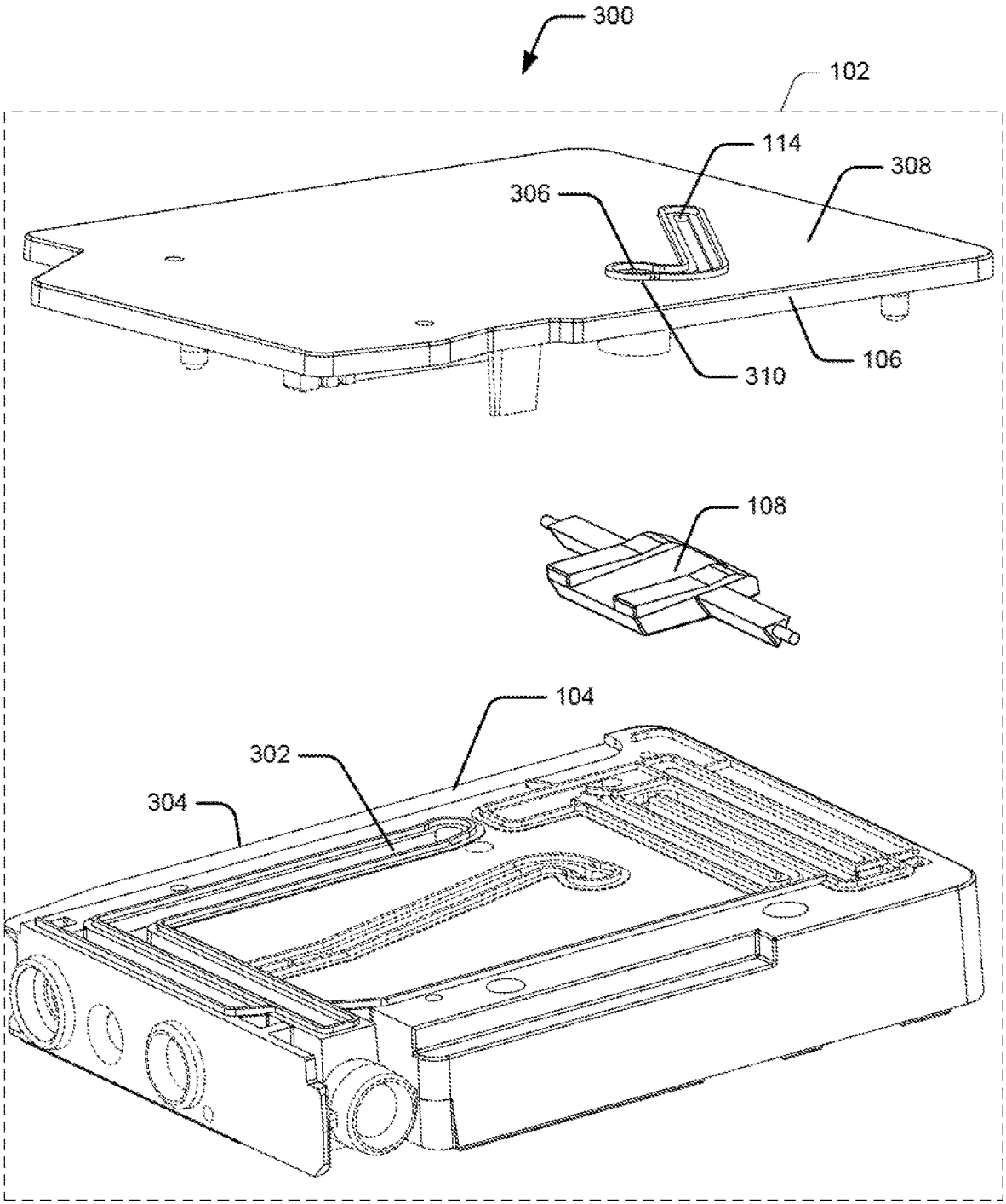
FIG. 3 illustrates an exploded view of a fluid cartridge, according to yet another example implementation of the present subject matter.

FIG. 3 illustrates an exploded view 300 of the fluid cartridge 102, according to yet another example implementation of the present subject matter. The fluid cartridge, in one example, includes the container 104 to hold a predetermined volume of the fluid and the lid 106 to be placed on the container 104, opposite to a first wall, for closing the container 104. The exploded view 300 illustrates a bottom view of the container 104 and a top view of the lid 106 to illustrate outer surfaces of the container 104 and the lid 106. As seen in FIG. 3, various components for which no protection is sought have been illustrated using dotted lines.

In one implementation, a first fluid channel 302 is provided on an outer surface 304 of the first wall of the container 104 to receive the replacement fluid. As previously describe, replacement fluid is received for replacing a depleted volume of the fluid in the container 104. Further, a second fluid channel 306 is provided on an outer surface 308 of the lid 106. In one example, the second fluid channel 306 is fluidly coupled to the first fluid channel 302 to receive the replacement fluid.

The lid 106 further includes the valve-recess 112 and the inlet valve 114 in the valve-recess 112. In one implementation, the inlet valve 114 is connected to a second end 310 of the second fluid channel 306 for transferring the replacement fluid to the container 104. Further, the fluid cartridge 102 includes the rocker valve 108 pivoted in the valve-recess 112. In one example implementation, the rocker valve 108 is to cover the inlet valve 114 during the regulation phase and open the inlet valve 114 during the actuation phase to allow the replacement fluid to enter the container 104.

Figure 4:
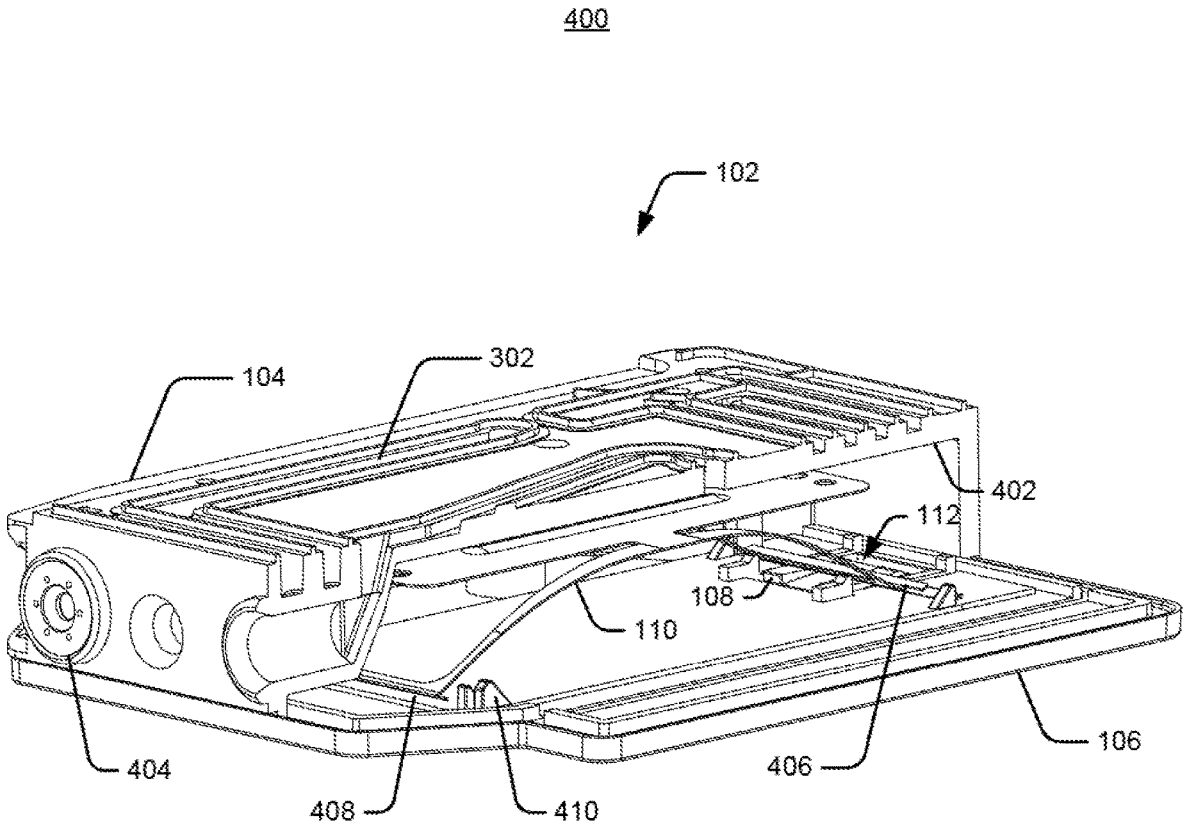
FIG. 4 illustrates a sectional view of a fluid cartridge, according to yet another example implementation of the present subject matter.

FIG. 4 illustrates a sectional view 400 of the fluid cartridge 102, according to yet another example implementation of the present subject matter. The sectional view 400 illustrates various components assembled inside the fluid cartridge 102. As seen in FIG. 4, the lid 106 is placed on the container 104, opposite to a first wall 402 of the container 104. In one example implementation, the container 104 and the lid 106 enclose the predetermined volume of fluid, such as ink, liquid toner, and other printing fluids for devices, such as printing devices, web presses, 3D printers, and lab equipment. The fluid cartridge 102 may thus be used as a source of fluid in the printing devices, web presses, 3D printers, and lab equipment for various applications, such as inkjet and similar printing applications, 3D printing applications, and lab applications.

In one implementation, the fluid cartridge 102 includes a first fluid interface 404 fluidly connecting the fluid cartridge 102 to a receiving structure (not shown in the figure) of the device for which the fluid cartridge 102 is acting as the source of fluid. For instance, the first fluid interface 404 may fluidly connect the fluid cartridge 102 to a printhead of a printing device for providing fluid, such as ink for printing on a print medium. To regulate and control the flow of the fluid to the receiving structure through the first fluid interface 404, the fluid cartridge maintains pressure inside the container 104 at a predetermined negative level.

The fluid cartridge 102 further includes a second fluid interface (not shown in this figure) for receiving the replacement fluid for replacing the volume of fluid depleted owing to use by the device, such as the printing device. In one example, the replacement fluid may be a gas, such as air. In another example, the replacement fluid may be the fluid as filled inside the fluid cartridge. The replacement fluid in such a case may be received form an external fluid source connected to the fluid cartridge 102. Receiving the replacement fluid, in one example, reduces the pressure inside the container 104, increased owing to depletion of the fluid. Further, the replacement fluid is received through the inlet valve 114 provided in the valve-recess 112 of the lid 106, the entry of the replacement fluid being controller by a pressure unit including the bag 202, the rocker valve 108, and the spring element 110.

As illustrated, the rocker valve 108 is placed inside the valve-recess 112 of the lid 106. The spring element 110, as illustrated, is placed on the lid 106 such that a first end 406 of the spring element 110 is slidably mounted on the rocker valve 108. In one example, the spring element 110 is slidably mounted on the rocker valve 108 to control actuation of the rocker valve 108 in accordance to the inflation and deflation of the bag 202. For instance, for the bag 202 being deflated, the spring element 110 is disposed in the regulation zone 116 of the rocker valve 108 to operate the rocker valve 108 in the regulation phase. For the bag 202 being inflated, the spring element 110 slides along the rocker valve 108 to be disposed in the actuation zone 118 to actuate the rocker valve 108 to operate in the actuation phase.

Further, a second end 408 of the spring element 110 rests against spring holders, such as a first spring holder 410 provided on the lid 106. As illustrated in the FIG. 4, the spring holders are provided on one end of the lid 106, opposite to another end on which the valve-recess 112 is provided.

Figure 5:
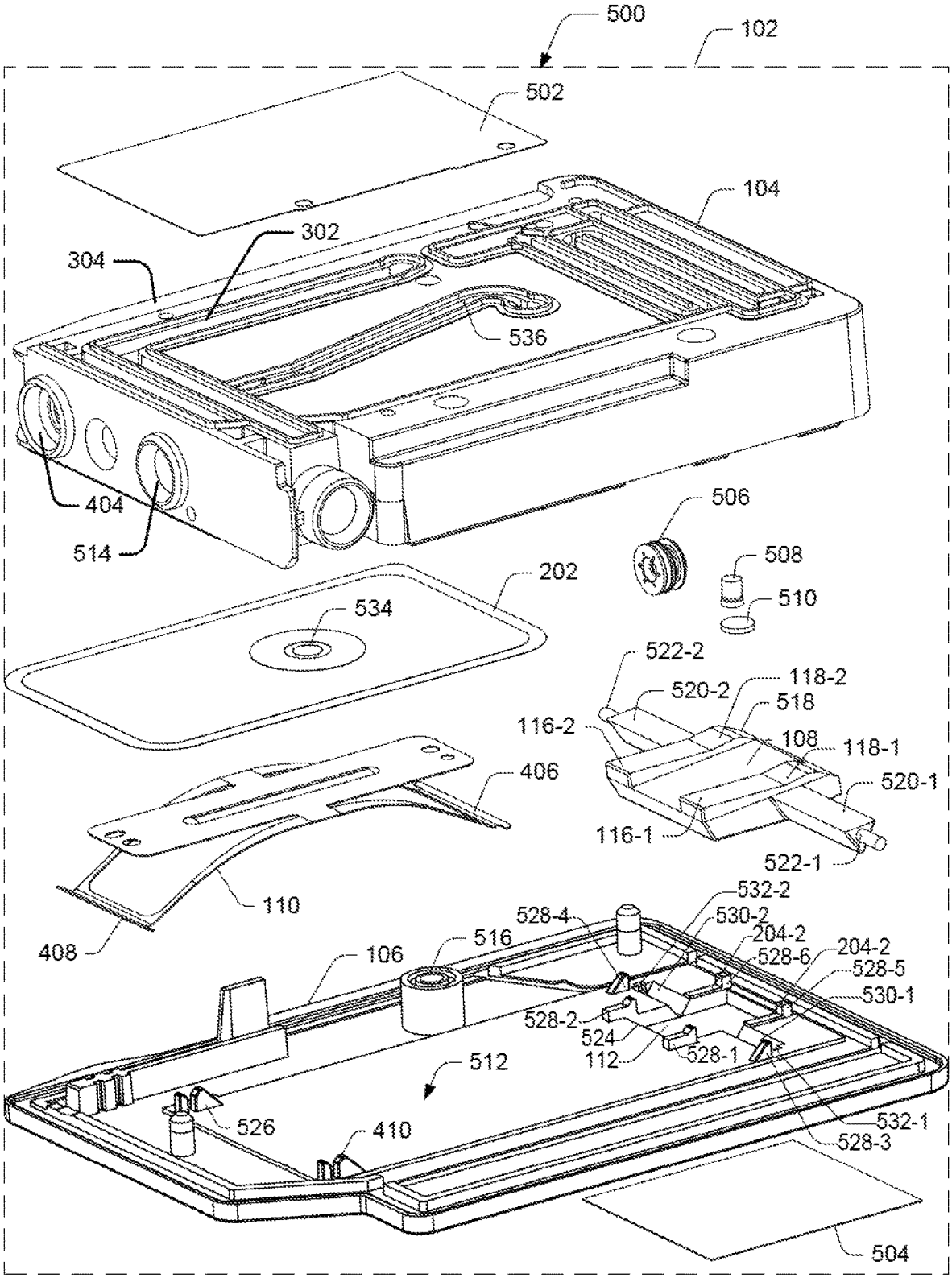
FIG. 5 illustrates an exploded view of a fluid cartridge, according to yet another example implementation of the present subject matter.

FIG. 5 illustrates an exploded view 500 of the fluid cartridge 102, according to yet another example implementation of the present subject matter. In one example, the fluid cartridge 102 includes the container 104, the lid 106, the rocker valve 108, the spring element 110, the bag 202, a container cover 502, a lid cover 504, a septum 506, a vent plug 508, and a valve seat disc 510. The exploded view 500 illustrates a bottom view of the container 104 and the lid 106 to illustrate the outer surface 304 of the container 104 and an inner surface 512 of the lid 106.

As previously described, the fluid cartridge 102 may be used as a source of fluid in the printing devices, web presses, 3D printers, and lab equipment. The fluid, such as ink, liquid toner, and other printing fluids is held inside the container 104 and the lid 106 is provided to cover an open side of the container 104. Further, the container cover 502 and the lid cover 504 are provided to cover the outer surfaces of the container 104 and the lid 106, respectively. In one example, the container cover 502 and the lid cover 504 may be labyrinth covers provided to seal fluid channels, such as the first fluid channel 302 and the second fluid channel 306 to seal leakage of the fluid from the container 104 and the lid 106.

Further, the container 104 includes the first fluid interface 404 and a second fluid interface 514. The first fluid interface 404 opens inside the container 104 to allow transfer of the fluid to the receiving structure. In one example, the septum 506 is provided within the second fluid interface 514 to engage the receiving structure and the container 104. The second fluid interface 514 is connected to the first fluid channel 302 for providing the replacement fluid to the container 104. In one example, if the replacement fluid is same as the fluid inside the container 104, the second fluid interface 514 may be connected to the external fluid source for receiving the replacement fluid.

Figure 6:
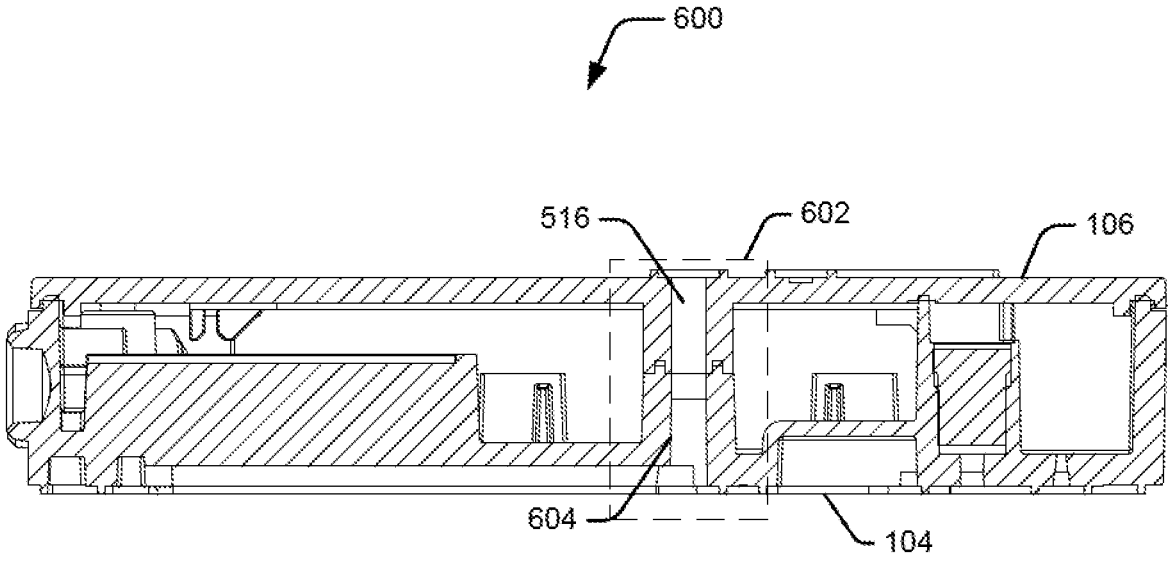
FIG. 6 illustrates a cross section view of a container of a fluid cartridge, according to another example implementation of the present subject matter.

As previously described, the first fluid channel 302 of the container 104 is fluidly coupled to the second fluid channel 306 of the lid 106. In one example implementation, the first fluid channel 302 is coupled to the second fluid channel 306 through an intermediate fluid channel as illustrated in FIG. 6. FIG. 6 illustrates a cross section view 600 of the container 104 and the lid 106 of the fluid cartridge 102, according to another example implementation of the present subject matter. As illustrated, an intermediate fluid channel 602 is provided within the container 104 and the lid 106 to form a fluidic connection between the first fluid channel 302 and the second fluid channel 306. The intermediate fluid channel 602 is fluidly coupled to the first fluid channel 302 and the second fluid channel 306 for transferring the replacement fluid to the lid 106. In one example, one end of the intermediate fluid channel 602 is connected to the first fluid channel 302 to receive the replacement fluid. Other end of the intermediate fluid channel 602 is connected to the second fluid channel 306 for transferring the replacement fluid to the second fluid channel 306.

In one example, the intermediate fluid channel 602 includes a first intermediate fluid channel 516 formed within the lid 106 and a second intermediate fluid channel 604 formed within the container 104. When the lid 106 is placed over the container 104, the first intermediate fluid channel 516 and the second intermediate fluid channel 604 join together to form the intermediate fluid channel 602.

Returning to FIG. 5, the bag 202 is disposed on the container 104 to maintain pressure inside the container 104. In one example, the bag 202 is to inflate and deflate in accordance to the volume of the fluid and the replacement fluid filled in the container. The bag 202 inflates as the pressure inside the container 104 increases due to depletion of the fluid from the container 104. The bag 202 deflates as the pressure decreases due to transfer of replacement fluid in the container 104. As previously described, the bag 202 is pressed against the first wall 402 of the container 104 by the spring element 110 to restrain the bag from inflating, to maintain the pressure inside the container 104.

The spring element 110, as previously described, is to pressed against the bag 202 and movable disposed on the rocker valve 108 such that the spring element 110 operates in one of the regulation phase, the actuation phase, and the hyperinflation phase in accordance to the inflation and deflation of the bag 202.

Figure 7:
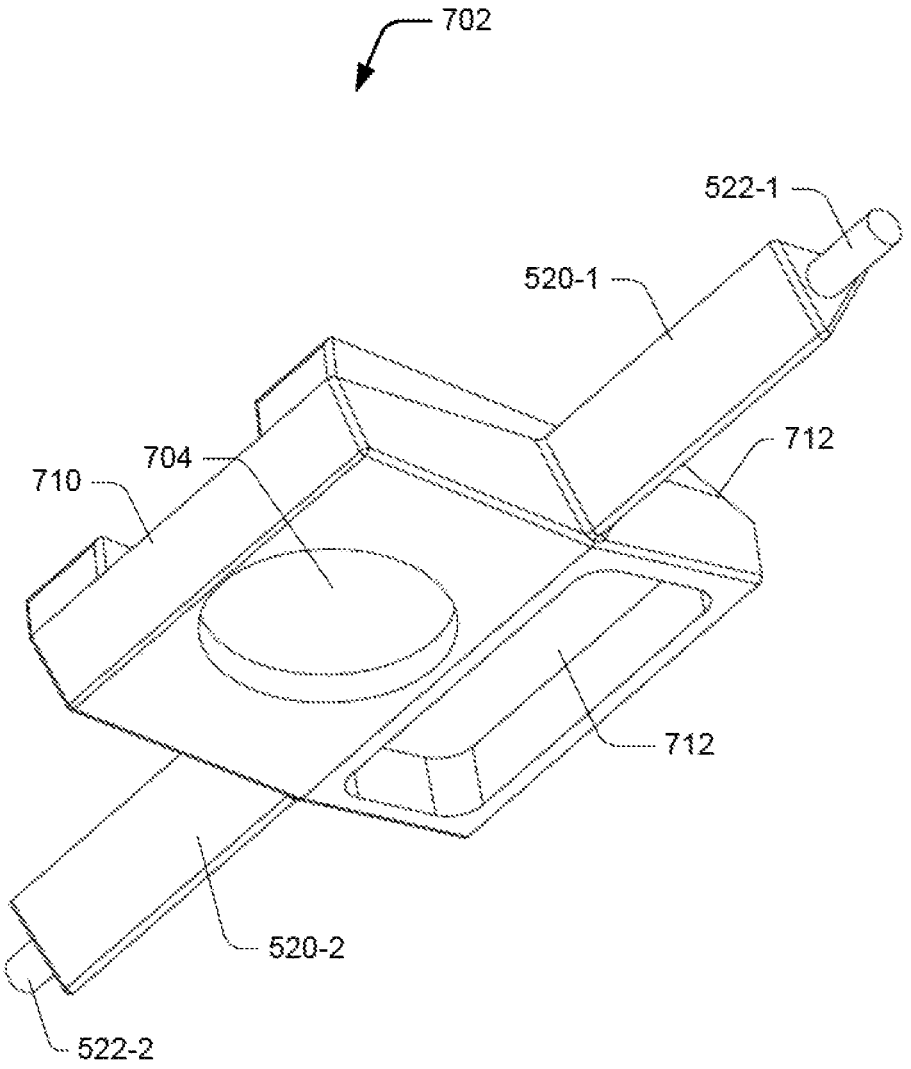
FIG. 7 illustrates a bottom view of a rocker valve of a fluid cartridge, according to yet another example implementation of the present subject matter.

The rocker valve 108, as previously described, is pivoted in the valve-recess 112 to control the actuation of the inlet valve 114 in accordance to the inflation and deflation of the bag 202. The rocker valve 108 is further explained with respect to FIG. 5 and FIG. 7. FIG. 7 illustrates a bottom view 702 of the rocker valve 108. As illustrated in FIG. 5 and FIG. 7, the rocker valve 108 includes the regulation zone 116, the actuation zone 118, a downward slant 518, a first fulcrum 520-1, a second fulcrum 520-2, a first snap post 522-1, a second snap post 522-2, a first recess 704, and a second recess 706.

The regulation zone 116, as illustrated, is a slanting portion extending over a larger portion of the rocker valve to cover the inlet valve 114 during the regulation phase. In one example, when the rocker valve 108 is placed inside the valve-recess 112, the regulation zone 116 may extend from a first end 524 of the valve-recess 112 to the inlet valve 114 such that in the regulation phase, the regulation zone 116 covers the inlet valve 114 entirely. The actuation zone 118 is provided adjacent to the regulation zone 116 such that when the rocker valve 108 is placed inside the valve-recess 112, the actuation zone 118 may extend from the inlet valve 114 to the hyperinflation zone 204 proximal to the second end 206 of the valve-recess 112. In one example, the actuation zone 118 is at an angle in the range of 5 degree to 20 degree with respect to the regulation zone 116.

The downward slant 518 is provided proximal to the second end 206 of the valve-recess 112 to allow the movement of the spring element 110 between the actuation zone 118 and the hyperinflation zone 204. In one example, the downward slant 518 is at an angle in the range of 15 degree to 45 degree with respect to the actuation zone 118.

The first fulcrum 520-1 and the second fulcrum 520-2, hereinafter referred to as fulcrum 520, are wedge shaped to provide a rocking movement to the rocker valve 108 for controlling actuation of the inlet valve 114. The fulcrum 520, thus, allows the spring element 110 to pivot the rocker valve 108 for opening or closing the inlet valve 114. Further, as illustrated in FIG. 5 and FIG. 7, a pivoting surface 708 of the rocker valve 108 meets the bottom edge of the fulcrum 520 to facilitate the rocking movement or the pivoting of the rocker valve 108. Further, as illustrated in FIG. 7, the rocker valve 108 has an inclined profile at the bottom such that a regulation zone end 710 and a downward slope end 712 are angled with respect to the pivoting surface 708 of the rocker valve 108 to facilitate the rocking movement of the rocker valve 108.

The first snap post 522-1 and the second snap post 522-2 are hereinafter collectively referred to as snap posts 522 and individually as snap post 522. In one example, the snap posts are provided on far ends of the fulcrum 520 to snap-fit the rocker valve 108 in the valve-recess 112. Providing the snap posts 522 for snap-fitting the rocker valve 108 helps in ensuring that the rocker valve 108 does not move from its position in the valve-recess 112 and fall down when the spring is not pressed against the rocker valve 108, for example, during the hyperinflation phase.

In one example implementation, the first recess 704 is provided in a portion between the regulation zone end 710 and pivoting surface 708 to receive the valve seat disc 510 for covering the inlet valve 114. The valve seat disc 510, in one implementation, is press-fit inside the first recess 704. The first recess 704 may thus securely hold the valve seat disc 510 to avoid the valve seat disc 510 from getting stuck to the inlet valve 114 due to weather conditions or during movement of the rocker valve 108. In one example, the vent plug 508 is placed in the inlet valve 114, beneath the valve seat disc 510 to act as a stopper to prevent the flow of fluid in the container 104 once the inlet valve 114 has been wetted.

The second recess 706 is provided in a portion between the pivoting surface 708 and the downward slope end 712. In one example, the second recess 706 is provided to reduce the material and thus weight from beneath the actuation zone 118 and the downward slant 518 to allow the movement of the rocker valve 108 from the hyperinflation phase to the regulation phase.

Figure 8:
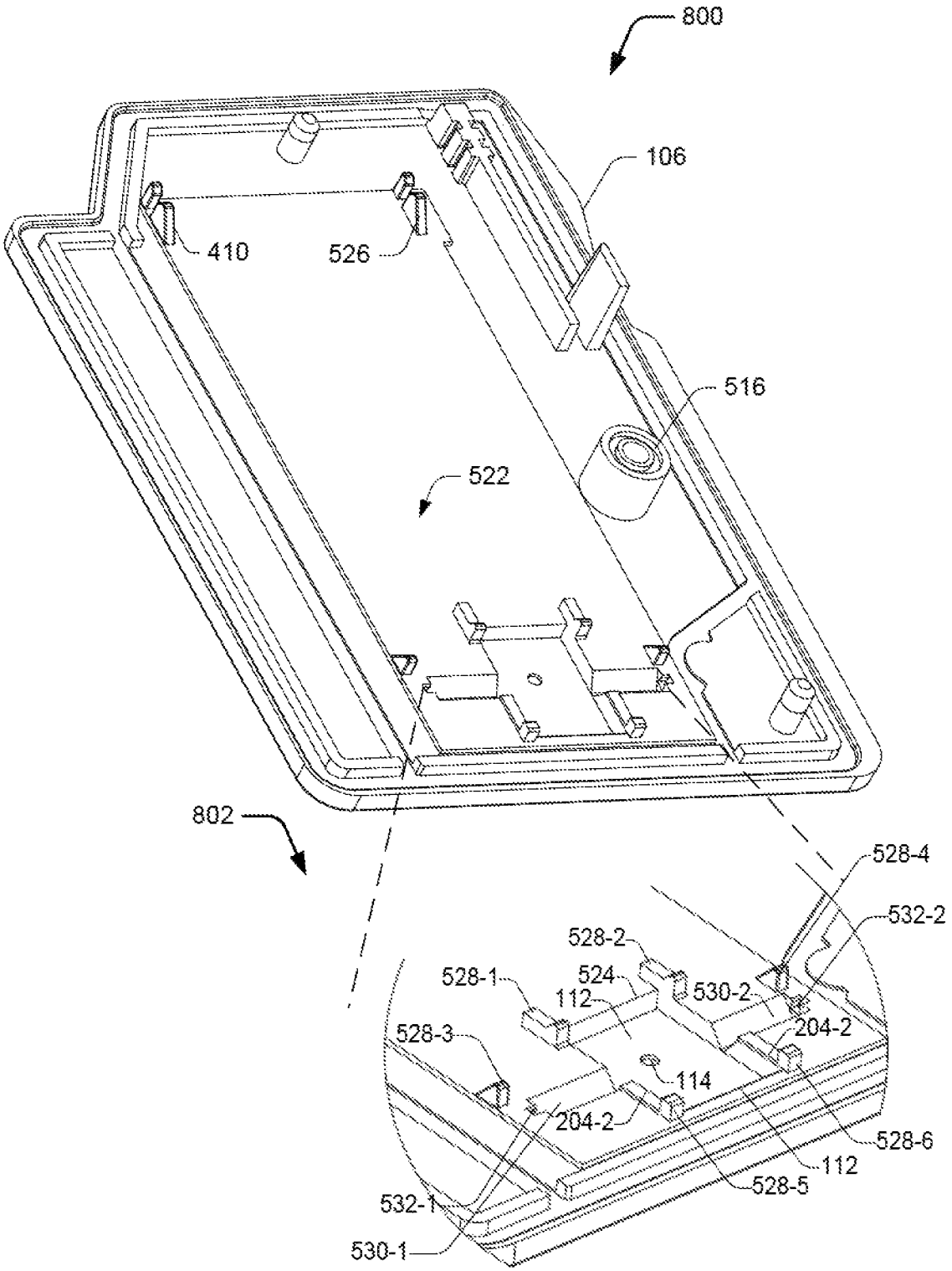
FIG. 8 illustrates a top view of a lid of a fluid cartridge, according to another example implementation of the present subject matter.

The lid 106 is to be placed over the container, opposite to the first wall 402 such that the inner surface 512 of the lid 106 is facing the first wall 402 of the container 104. Description of the lid 106 is further provided in conjunction with FIG. 8. FIG. 8 illustrates a top view 800 of the lid 106 with an expanded view 802 of the valve-recess 112 and its surrounding components on the lid 106, according to another example implementation of the present subject matter.

The lid 106 houses the inlet valve 114 and the pressure unit apart from the bag 202. As illustrated, the lid 106 houses the valve-recess 112, the inlet valve 114, the first spring holder 410, a second spring holder 526, a first spring stopper 528-1, a second spring stopper 528-2, a third spring stopper 528-3, a fourth spring stopper 528-4, a fifth spring stopper 528-5, and a sixth spring stopper 528-6.

As previously described, the valve-recess 112 is provided to receive the rocker valve 108 for controlling the opening and closing of the inlet valve 114 provided in the valve-recess 112. In one example, the valve-recess 112 includes a first fulcrum groove 530-1, a second fulcrum groove 530-2, a first snap post groove 532-1, a second snap post groove 532-2, and the inlet valve 114. The first fulcrum groove 530-1 and the second fulcrum groove 530-2 receive the first fulcrum 520-1 and the second fulcrum 520-2 respectively. Further, the first snap post groove 532-1, a second snap post groove 532-2 receive the first snap post 522-1 and the second snap post 522-2, respectively, to snap fit the rocker valve 108 in the valve-recess 112. The first fulcrum groove 530-1 and the second fulcrum groove 530-2 are hereinafter collectively referred to as fulcrum groove 530 and individually as fulcrum groove 530. The first snap post groove 532-1, a second snap post groove 532-2 are hereinafter collectively referred to as snap post groove 532 and individually as snap post groove 532.

The first spring holder 410 and the second spring holder 526, hereinafter collectively referred to as spring holders 410, 526, are provided on the lid 106 at the end opposite to the end on which the valve-recess 112 is provided. In one example, the second end 408 of the spring element 110 rests against the spring holders 410, 526 when the spring element 110 is disposed on the lid 106. The spring holders 410, 526 thus hold the spring element 110.

The first spring stopper 528-1, the second spring stopper 528-2, the third spring stopper 528-3, the fourth spring stopper 528-4, the fifth spring stopper 528-5, and the sixth spring stopper 528-6 are hereinafter collectively referred to as spring stoppers 528 and individually as spring stopper 528. In one example implementation, the spring stoppers 528 regulate the movement of the spring element 110 in the x-axis and y-axis as the spring element 110 moves over the rocker valve 108 during the operation of the fluid cartridge 102. In one example, the first spring stopper 528-1 and the second spring stopper 528-2 regulate the movement of the spring element 110 in the x-axis to check the spring element 110 from sliding away from its placement on the valve-recess 112. The third spring stopper 528-3, the fourth spring stopper 528-4, the fifth spring stopper 528-5, and the sixth spring stopper 528-6 regulate the movement of the spring element 110 in the y-axis to check the over travel of the spring element 110 over the valve-recess 112.

For operation, the fluid cartridge 102 is initially connected with the receiving structure such that the first fluid interface 404 connects to a fluid interface of the receiving for providing the fluid. Further, various components of the fluid cartridge 102 are assembled such that the bag 202 is pressed against first wall 402 of the container 104 by the spring element 110. Further, the spring element 110 is mechanically attached to the first wall 402 of the container 104 and mounted on the lid 106. The spring element 110 is further movably disposed on the rocker valve 108 pivotally placed in the valve-recess 112. As previously described, the rocker valve 108 is placed inside the valve-recess 112 such that the fulcrum groove 530 and the snap post groove 532 receive the fulcrum 520 and the snap posts 522, respectively to snap-fit the rocker valve 108 in the valve-recess 112.

Figure 9:
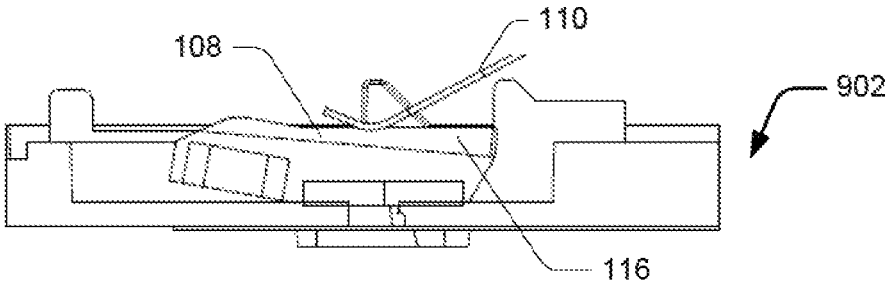
FIG. 9 illustrates a spring element and a rocker valve at various stages of operation of a fluid cartridge, according to an example implementation of the present subject matter.
Figure 9:
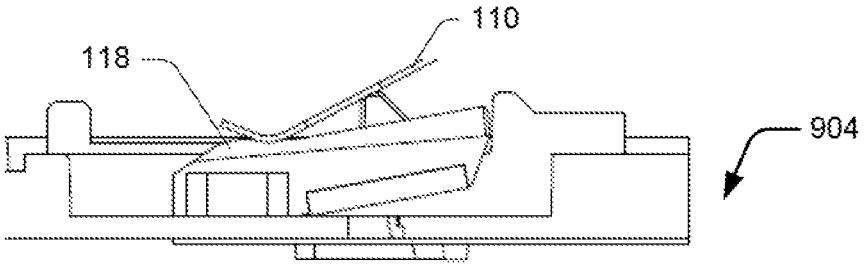
Figure 9:
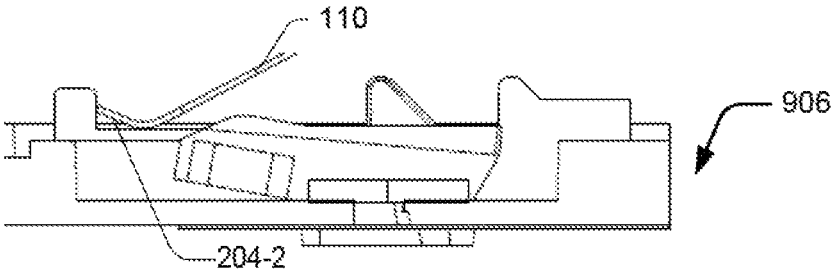

The operation of the fluid cartridge 102 is further explained in conjuncture with FIG. 9. FIG. 9 illustrates the spring element 110 and the rocker valve 108 at various stages of operation of the fluid cartridge 102, according to an example implementation of the present subject matter. Initially, as the container 104 is filled with the predetermined volume of fluid, negative pressure is maintained inside the bag 202 and the pressure unit, i.e., is in its default position. In the default position, the bag 202 is deflated and the spring element 110 operates in the regulation phase, as illustrated in step 902. As previously described, in regulation phase the spring element 110 is disposed in the regulation zone 116 of the rocker valve 108 to regulate the rocker valve 108 to cover the inlet valve 114 to stop the replacement fluid from entering the container 104.

As the fluid from the container 104 is consumed, the pressure inside the container 104 starts to increase, owing to which the bag 202 starts to deflate. In one example, the bag 202 includes an opening 534 fluidly coupled to a third fluid channel 536 of the container 104. The opening 534 allows gas, such as ambient air to enter in and move out of the bag 202 as the bag 202 inflates and deflates. As the bag 202 starts to inflate, the spring element 110 tries to restrain the bag 202 from expanding to maintain the pressure inside the container 102. As the bag 202 further inflates, the string element 110 gets pushed such that the first end 406 of the spring element 110 starts to slide over the rocker valve 108. As the pressure inside the container increase beyond a predefined limit, the bag 202 inflates to a predetermined level, pushing the spring element 110 to operate in the actuation phase.

In the actuation phase, the spring element 110 slides along the regulation zone 116 of the rocker valve 108 to be disposed in the actuation zone 118 as illustrated in step 904. As the spring element 110 slides over to the actuation zone 118, the activation zone 118 gets pushed towards the valve-recess 112, owing to which the rocker valve 108 pivots along the fulcrum 520. As the rocker valve 108 pivots, the regulation zone 116 portion of the rocker valve 108 lifts up, thus opening the inlet valve 114.

Once the inlet valve 114 opens, the replacement fluid starts entering the container, decreasing the pressure inside the container 104. As the pressure inside the container 104 reduces, the bag 202 starts to deflate, allowing the spring element 110 to retract over the rocker valve 108. Once the pressure inside the container decreases below the predefined level, the bag 202 deflates further such that the spring element 110 slides back to the regulation zone 116 from the actuation zone 118. As the spring element 110 slides back on to the regulation zone 116, the rocker valve 108 pivots back to cover the inlet valve 114 to operate in the regulation phase and stop the replacement fluid from entering the container 104.

In one example implementation, the pressure unit may further facilitate in priming the fluid cartridge 102 and the receiving structure, such as the printhead of a printing device. Priming the fluid cartridge 102 and the receiving structure involves allowing the fluid to eject through the first fluid interface 404 into the printhead at a high speed to dean the first fluid interface 404, the printhead, and nozzles of the printhead. To initiate the priming, the bag 202 is inflated to extend beyond the predetermined level making the spring element 110 to slide over the rocker valve 108 to the actuation zone 118 to allow the replacement fluid enter. In one example, the bag 202 is inflated with gas pumped by an external pump connected to the fluid cartridge 102. As the bag 202 continues to inflate, the spring element moves further on the actuation zone 118 to allow more replacement fluid to enter the container 104 to increase the fluid flow out of the container 104.

As the bag 202 inflates further beyond a predefined level, the spring element 110 slides off the actuation 118 of the rocker valve 108 to be disposed in the hyperinflation zone 204, as illustrated in step 906. In one example, the spring element 110 initially slides off the actuation zone 118 to the downward slope 518 of the rocker valve 108 and then moves over to the hyperinflation zone 204. Once the spring element 110 slides over to the hyperinflation zone 204, the rocker valve 108 pivots back to cover the inlet valve 112 owing to the fulcrum 520 and the weight distribution of the rocker valve 108. As previously described, the second recess 706 makes the actuation zone 118 lighter in weight in comparison to the regulation zone 116, thus allowing the rocker valve 108 to pivot back to its default position.

As the rocker valve 108 covers the inlet valve 114, the replacement fluid stops entering the container 104 and the remaining fluid form the container 104 is ejected out of the nozzle. Once, the priming is completed, the external pump stops pumping the gas in the bag 202 and the bag 202 starts to deflate. As the bag 202 deflates, the spring element 110 retracts and slides over form the hyperinflation zone 204 to the downward slope 518 of the rocker valve 108 and in turn to the actuation zone 118 and the finally the regulation zone 116.

The bag 202, the spring element 110, and the rocker valve 108 thus work to regulate the entry of the replacement fluid inside the container 104 to maintain the pressure inside the container 104 for default functioning and priming.

Although examples for the present subject matter have been described in language specific to structural features and/or methods, it should be understood that the appended claims are not limited to the specific features or methods described. Rather, the specific features and methods are disclosed and explained as examples of the present subject matter.

What is claimed is:

1. A fluid cartridge comprising:
a container to hold a predetermined volume of fluid;
a lid for closing the container, the lid comprising:
a valve-recess; and
an inlet valve in the valve-recess to transfer a volume of a replacement fluid in the container, for replacing a depleted volume of fluid in the container;
a rocker valve pivoted in the valve-recess to cover the inlet valve during a regulation phase, wherein the rocker valve is to open the inlet valve during an actuation phase to allow the replacement fluid to enter the container; and
a spring element movably disposed on the rocker valve to control actuation of the rocker valve for opening and closing the inlet valve, wherein the spring element slides across the rocker valve, from a regulation zone of the rocker valve to an actuation zone of the rocker valve, to open the inlet valve.

2. The fluid cartridge as claimed in claim 1, further comprising:
a bag disposed on the container to maintain pressure inside the container, wherein the bag inflates as the pressure inside the container increases due to depletion of the fluid from the container, and wherein the bag deflates as the pressure decreases due to transfer of replacement fluid in the container.

3. The fluid cartridge as claimed in claim 2, wherein the spring element is pressed against the bag to restrain the bag from inflating, to maintain the pressure, and wherein the spring element operates in one of the regulation phase, the actuation phase, and a hyperinflation phase in accordance to the inflation and deflation of the bag.

4. The fluid cartridge as claimed in claim 3, wherein in the hyperinflation phase, the spring element slides off the rocker valve to be disposed in a hyperinflation zone proximal to a second end of the valve-recess to allow the bag to be hyper-inflated for priming the fluid cartridge.

5. The fluid cartridge as claimed in claim 4, wherein the rocker valve comprises:
a plurality of snap posts to snap-fit the rocker valve in the valve-recess to keep the rocker valve placed in the valve-recess during the hyperinflation phase; and
a downward slant, proximal to the second end of the valve-recess, to allow the movement of the spring element between the rocker valve and the valve-recess.

6. The fluid cartridge as claimed in claim 1, wherein the container comprises:
a first fluid channel on an outer surface of a first wall of the container, wherein the first fluid channel is to receive the replacement fluid; and
an intermediate fluid channel fluidly coupled to the first fluid channel and a second fluid channel of the lid, for transferring the replacement fluid to the lid.

7. A fluid cartridge comprising:
a container to hold a predetermined volume of fluid;
a lid for closing the container, the lid comprising:
a valve-recess; and
an inlet valve in the valve-recess to transfer a replacement fluid for replacing a depleted volume of fluid in the container;
a rocker valve pivoted in the valve-recess to cover the inlet valve during a regulation phase, and wherein the rocker valve is to open the inlet valve during an actuation phase to allow the replacement fluid to enter the container;
a bag disposed on the container to maintain pressure inside the container, wherein the bag inflates as the pressure inside the container increases due to depletion of the fluid from the container; and
a spring element mounted on the lid and pressed against the bag to restrain the bag from inflating, wherein the spring element is movably disposed on the rocker valve to control actuation of the rocker valve for opening and closing the inlet valve, wherein in a hyperinflation phase, the spring element slides off the rocker valve to be disposed in a hyperinflation zone proximal to a second end of the valve-recess to allow the bag to be hyper-inflated for priming the fluid cartridge.

8. The fluid cartridge as claimed in claim 7, wherein the container comprises:
a first fluid channel on an outer surface of a first wall of the container, wherein the first fluid channel is to receive the replacement fluid; and
an intermediate fluid channel fluidly coupled to the first fluid channel and a second fluid channel of the lid, for transferring the replacement fluid to the lid.

9. The fluid cartridge as claimed in claim 7, wherein the spring element controls actuation of the rocker valve in accordance to the inflation and deflation of the bag, wherein for the bag being deflated, the spring element is disposed in a regulation zone of the rocker valve to operate the rocker valve in the regulation phase, and wherein for the bag being inflated, the spring element slides along the rocker valve to be disposed in an actuation zone to actuate the rocker valve to operate in the actuation phase.

10. The fluid cartridge as claimed in claim 9, wherein the rocker valve comprises a downward slant, proximal to the second end of the valve-recess, to allow the movement of the spring element between the actuation zone of the rocker valve and the hyperinflation zone of the valve-recess.

11. The fluid cartridge as claimed in claim 9, wherein the rocker valve comprises:
a plurality of snap posts to snap-fit the rocker valve in the valve-recess;
a first recess for receiving a valve seat disc for covering the inlet valve; and
a second recess to allow the movement of the rocker valve from the hyperinflation phase to the regulation phase.

12. A fluid cartridge comprising:
a container to hold a predetermined volume of fluid, the container comprising:
a first fluid channel on an outer surface of a first wall of the container, wherein the first fluid channel is to receive a replacement fluid for replacing a depleted volume of fluid in the container;
a lid to be placed on the container, opposite to the first wall, for closing the container, the lid comprising:
a second fluid channel on an outer surface of the lid, wherein the second fluid channel is fluidly coupled to the first fluid channel to receive the replacement fluid;
a valve-recess; and
an inlet valve in the valve-recess, the inlet valve connected to a second end of the second fluid channel for transferring the replacement fluid to the container, and
a rocker valve pivoted in the valve-recess provided in the lid, the rocker valve is to cover the inlet valve during a regulation phase and to open the inlet valve during an actuation phase to allow the replacement fluid to enter the container.

13. The fluid cartridge as claimed in claim 12, further comprising:

a bag disposed on the container to maintain pressure inside the container, wherein the bag inflates as pressure inside the container increases due to depletion of the fluid from the container, and wherein the bag deflates as pressure decreases due to transfer of replacement fluid in the container; and a spring element mounted on the lid and pressed against the bag to restrain the bag from inflating, wherein the spring element is movably disposed on the rocker valve to control actuation of the rocker valve for opening and closing the inlet valve phase in accordance to the inflation and deflation of the bag.

14. The fluid cartridge as claimed in claim 13, wherein the spring element is to operate in one of:

the regulation phase, wherein the spring element is disposed in a regulation zone of the rocker valve to regulate the rocker valve to cover the inlet valve;

the actuation phase, wherein the spring element is to slide along the rocker valve to be disposed in an actuation zone in accordance to inflation of the bag to actuate the rocker valve to open the inlet valve; and a hyperinflation phase, wherein the spring element slides off the rocker valve to be disposed in a hyperinflation zone proximal to a second end of the valve-recess to allow the bag to be hyper-inflated for priming the fluid cartridge.

15. The fluid cartridge as claimed in claim 12, wherein the rocker valve comprises:

a plurality of snap posts to snap-fit the rocker valve in the valve-recess;

a first recess for receiving a valve seat disc for covering the inlet valve; and a second recess to allow the movement of the rocker valve from a hyperinflation phase to the regulation phase.

* * * * *